US005145444A

United States Patent [19]

VanKuiken

[11] Patent Number: 5,145,444

[45] Date of Patent: Sep. 8, 1992

[54] STROBE LIGHT EFFECT YO-YO

[76] Inventor: Jack C. VanKuiken, 419 Lincoln Ave., Downers Grove, Ill. 60515

[21] Appl. No.: 721,937

[22] Filed: Jun. 27, 1991

[51] Int. Cl.[5] ..... A63H 1/24; A63H 1/30

[52] U.S. Cl. ..... 446/242; 446/485

[58] Field of Search ..... 446/242, 485, 48, 219, 446/250

[56] References Cited

U.S. PATENT DOCUMENTS

| | | | |
|---|---|---|---|
| 3,191,344 | 2/1962 | Yagjian | 446/242 |
| 3,745,697 | 7/1973 | Wang | 446/242 |
| 3,812,614 | 5/1974 | Harrington | 446/47 |
| 4,327,518 | 5/1982 | Knauff | 446/242 |
| 4,563,160 | 1/1986 | Lee | 446/242 X |
| 4,867,727 | 9/1989 | Lanius | 446/242 |

FOREIGN PATENT DOCUMENTS

| | | | |
|---|---|---|---|
| 1604881 | 12/1981 | United Kingdom | 446/406 |

*Primary Examiner*—Mickey Yu

*Attorney, Agent, or Firm*—Lee, Mann, Smith, McWilliams, Sweeney & Ohlson

[57] ABSTRACT

A rotatable toy in which a light emitting diode, positioned in one of the body halves, is connected to a solid state control circuit which includes a timer to periodically energize the LED and produce a stroboscopic effect.

17 Claims, 2 Drawing Sheets

STROBE LIGHT EFFECT YO-YO

BACKGROUND OF THE INVENTION

The present invention is directed to an illuminated rotatable toy of the type generally referred to as a "yo-yo". Other rotary toys have incorporated illumination features in them often including switches which are activated by centrifugal force to illuminate the toy. See, for example, U.S. Pat. Nos. 3,191,344; 3,745,697; 4,327,518 and 4,867,727. Another approach has been used to provide a stroboscopic light source on the rim of a "Frisbee" as illustrated in U.S. Pat. No. 3,812,614. None of these approaches provide the novel effect of the present invention.

SUMMARY OF THE INVENTION

The present device consists of a rotatable toy, the preferred embodiment of which is disclosed herein as a yo-yo. During operation, a light emitting diode mounted in the outer rim of at least one of the body halves flashes on and off at a predetermined frequency to produce a stroboscopic effect making it seem as if the yo-yo is standing still when it is, in fact, spinning. This is accomplished utilizing a solid state control circuit carried by one of the body halves and connected between a power source and the light emitting diode. A timer produces flashing of the diode at the predetermined rate.

DETAILED DESCRIPTION OF THE PREFERRED EMBODIMENT

Figure 5:
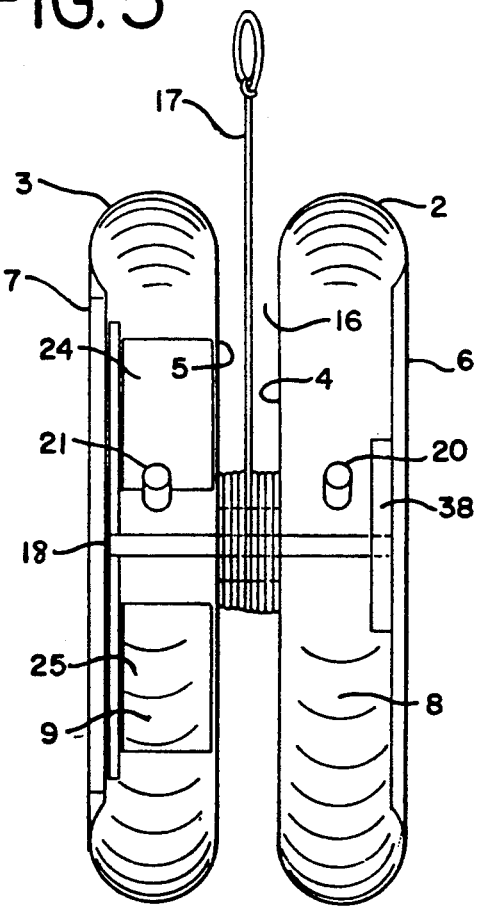
FIG. 5 is an end view of the embodiment shown in FIG. 2.

The present invention is directed to an illuminated rotatable toy, the preferred embodiment illustrated as a yo-yo, which provides a stroboscopic effect. Generally, as shown in FIG. 5, the yo-yo includes a pair of cup shaped body halves 2 and 3, each having a respective inner surface 4 and 5, and a respective outer surface 6 and 7. A rim surface 8 connects the surfaces 4 and 6. A rim surface 9 connects the surfaces 5 and 7. A cover member 10 is fixedly secured over the cup shaped portion of body half 2 and forms a portion of its outer surface 6. This cover member 10 forms a chamber 11 in the body half 2. A second cover member 12 is fixedly secured to the body half 3 and forms a portion of the outer surface 7 of the body half 3. The cover member 12 forms a chamber 13 within the cup shaped body half 3. This cover member 12 includes a pair of apertures **14*a* and 14*b* whose function will be discussed later. The body halves 2 and 3** are preferably made of translucent material to maximize the stroboscopic effect, but opaque materials can be used.

Figure 3:
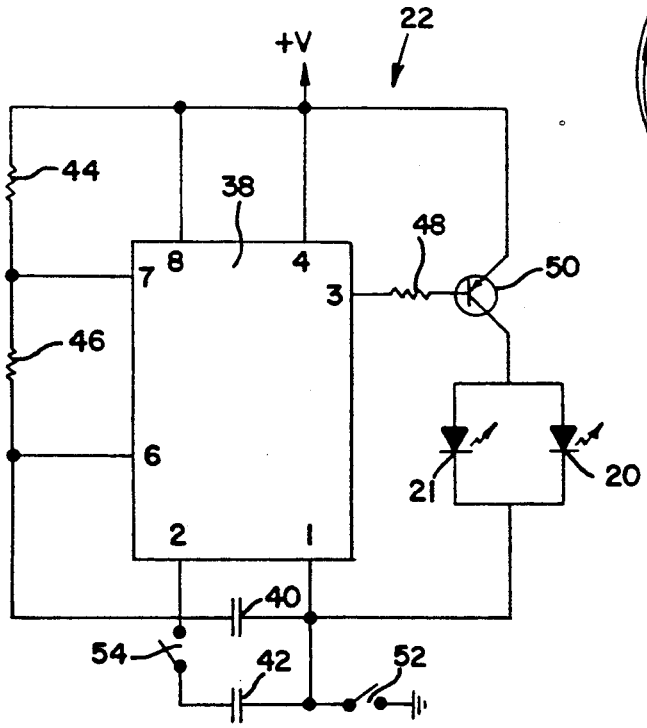
FIG. 3 is a schematic drawing of the control circuit utilized in the present invention.
Figure 6:
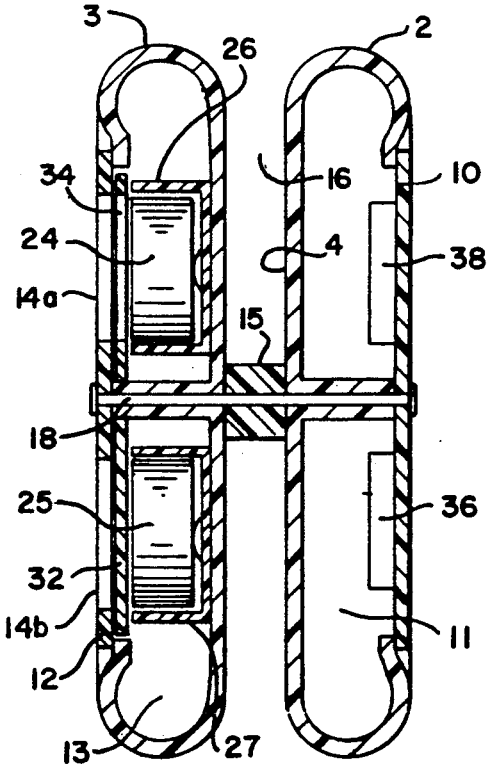
FIG. 6 is a cross-sectional view of the embodiment shown in FIG. 2.

A hollow axle 15, as best shown in FIG. 6, is disposed between the body halves 2 and 3 such that the inside surfaces 4 and 5 are parallel and spaced apart from each other to define a gap 16. A string 17, shown in FIG. 5, extends through the gap 16 and is rotatably secured around the axle 15. A fastener 18 extends through the axle 15 and secures the body halves 2 and 3 and cover members 10 and 12 together. A pair of light emitting diodes 20 and 21 is mounted at the rims 8 and 9 of the body halves 2 and 3. A solid state control circuit 22, shown schematically in FIG. 3, is mounted in chamber 11 of body half 2. A pair of button-type batteries 24 and 25 are removably mounted in chamber 13 of body half 3. The batteries 24 and 25 are preferably 1.5 volt alkaline A76 batteries manufactured by Eveready, but other light-weight batteries also have provided satisfactory weight and size requirements.

As best shown in FIG. 6, the batteries 24 and 25 are recessed in a pair of battery wells 26 and 27 which are fixedly secured in the chamber 13 of body half 3. Each battery well 26 and 27 includes a spring (not shown) which biases the batteries 24 and 25 out of the wells 26 and 27 which spring is connected to the control circuit 22. The apertures **14*a* and 14*b* of the cover member 12 are positioned in alignment with the battery wells 26 and 27 and provide for access to the battery wells 26 and 27. Located between the cover member 12 and the battery wells 26 and 27 is a rotatable disc 32. This disc 32 includes an aperture 34 of the same shape and size as the apertures 14*a* and 14*b*. In operation, the disc 32 is rotated such that the aperture 34 is in alignment with either aperture 14*a* or 14*b* in the cover member 12. This allows for installation or removal of the batteries 24 and 25. For example, aperture 34 is rotated to align with aperture 14*a*, in the cover member 12 and a battery 24 is positioned within battery well 26. The disc 32 is then rotated to align with the second aperture 14*b* in the cover member 12. The other battery 25 is inserted into battery well 27 and the disc 32 is further rotated to the position shown in FIG. 4 such that the aperture 34 is not in alignment with either aperture 14*a* or 14*b*, thereby securing the batteries 26 and 27** in place.

Wires (not shown) extend through the axle 15 and connect the control circuit 22 to the batteries 24 and 25. The control circuit 22 in body half 2 and the batteries 24 and 25 in body half 3, are positioned such that proper balance is maintained around the axis of rotation. As shown in FIG. 3, the control circuit 22 includes a three position slide-switch 36, an integrated timer circuit 38, a pair of capacitors 40 and 42 mounted in parallel with respect to each other, a pair of resistors 44 and 46, a biasing resistor 48 and a transistor 50. The slide-switch 36 energizes the diodes 20 and 21 and the particular position of the slide-switch 36 selects one of two frequencies which produce different visual strobe effects as the yo-yo rotates. The faster the strobe frequency, the denser the patterns of light segments produced at the yo-yo's circumference. The integrated timer circuit 38 allows for periodic energization of the diodes 20 and 21 to produce the stroboscopic effect when the yo-yo is rotated. Preferably the integrated timer circuit 38 is a TLC 555CD timer, manufactured by Texas Instruments.

Figure 2:
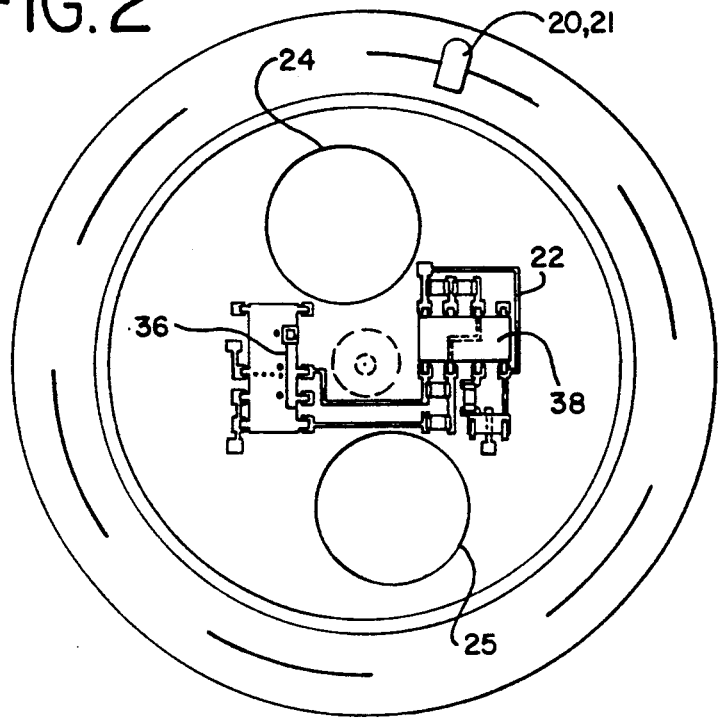
FIG. 2 is a side view of the device shown in FIG. 1 showing the light pattern produced at a slow frequency.
Figure 1:
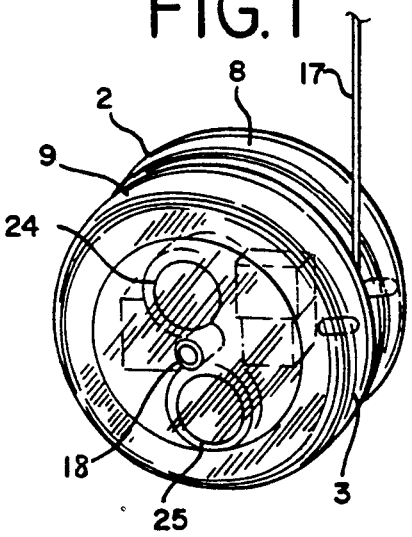
FIG. 1 is a perspective view of a preferred embodiment of the present invention.
Figure 4:
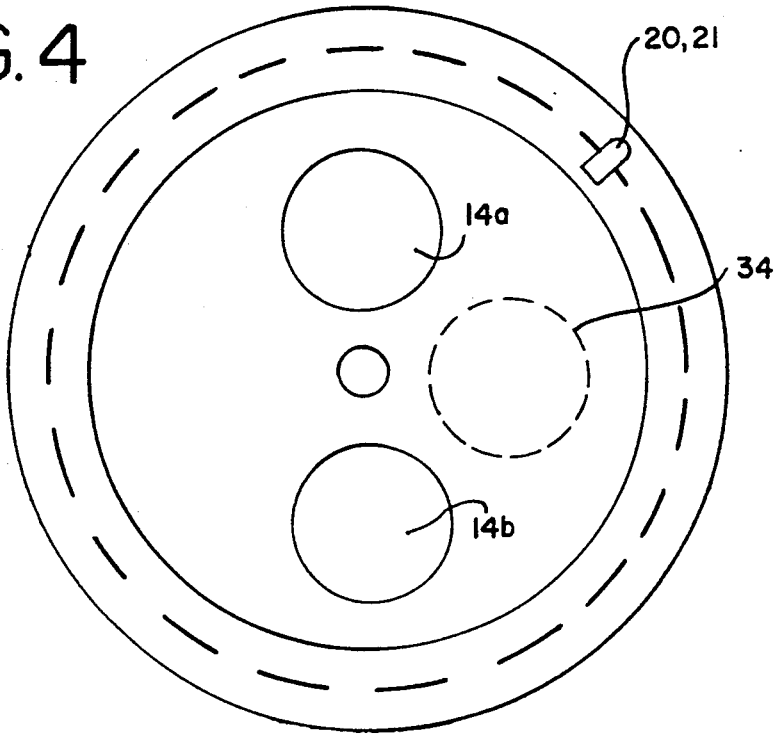
FIG. 4 is a side view of the present invention showing the light pattern produced at a fast frequency.

When the slide-switch 36 is moved to the first position, a switch portion 52 is closed and a switch portion 54 remains open. Closing of the switch portion 52 activates the timer circuit 38, which, depending on the RC time constant established, periodically energizes the base of the transistor 50. When the transistor 50 is energized, it conducts the voltage V from the batteries 24 and 25, lighting the diodes 20 and 21. Obviously, when the slide-switch 36 is at this first position, only capacitor 40 is in the circuit. This results in a fast strobe frequency as the yo-yo rotates. FIG. 4 shows the light pattern produced at a fast frequency. When the slide-switch 36 is adjusted to the next position, the switch portion 52 remains closed, and the switch portion 54 is also closed and allows for both parallel capacitors 40 and 42 to be in the circuit, thereby providing a slower frequency depending on the capacitance of the two capacitors 40 and 42. FIG. 2 shows the light pattern produced at a slower frequency as the yo-yo rotates.

The capacitors 40 and 42 operate in conjunction with the resistors 44 and 46 to determine the RC time constant which in turn determines the rate at which the timer 38 periodically activates the timer circuit 38 to energize the diodes 20 and 21 to produce the stroboscopic effect as the yo-yo is rotated. Biasing resistor 48 limits the current which flows through the transistor 50 thereby preventing damage to the diodes 20 and 21 and also controls the battery drain.

In one form of the invention the resistors 44 and 46 were provided at 110 Kohms apiece, the resistor 48 at 5.1 Kohm, the capacitor 40 at 0.0047 μf and the capacitor 42 at 0.015 μf, with individual battery voltage of 1.5 V. This produces rapid strobing of the diodes 20 and 21 which is undiscernible to the naked eye when the yo-yo is not rotating, but provides the strobing pattern of FIGS. 2 or 4 as the yo-yo rotates. Various other circuit values could be used to provide the strobing effect.

It should be apparent that one skilled in the art could devise other circuits to perform the same functions. Various capacitors, resistors, transistors and light emitting diodes, colored and uncolored, can be used to provide for different frequencies, brightness, colors and currents. Additional resistors and/or capacitors may be added with multiple switch positions to provide more than two strobe frequencies. The features of the present invention could also be applied to other rotary toys.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed:

1. A return top toy including a pair of spaced body halves having inner surfaces facing each other and outer surfaces facing away from each other; a rim surface disposed between and connecting said inner and outer surfaces and forming the periphery of each of said body halves; an axle disposed between and spacing apart said body halves; at least one light emitting diode carried by at least one of said body halves; a solid state control circuit carried by said body halves and connected to said light emitting diode, said circuit effective to cause said diode to flash on and off so as to produce a stroboscopic effect; and, a power source carried by one of said body halves and connected to said control circuit to power said light emitting diode, means for securing said power source in one of said body halves, said means including a cover member which forms a portion of said outer surface of one of said body halves and encloses a chamber in said body half, said cover member including at least one aperture for allowing access to said power source.

2. A return top toy as in claim 1 including a transistor switch connected to said control circuit to turn said light emitting diode on and off.

3. A return top toy as in claim 1 in which said control circuit is operative to activate said LED at a plurality of predetermined frequencies.

4. A return top toy as in claim 3 in which said control circuit includes timing means operative at said plurality of predetermined frequencies to periodically energize said LED to produce said stroboscopic effect.

5. A return top toy as in claim 4 including a manually operated switch connected to said control circuit operative to determine the desired frequency of operation of said LED.

6. A return top toy as in claim 1 including an LED disposed in each body half.

7. A return top toy as in claim 1 in which each body half is formed of translucent material so as to display light emitted from said light emitting diode.

8. A return top toy as in claim 1 including a rotatable disc positioned between said cover member and said chamber said disc defining an aperture such that alignment of said disc aperture and said cover member aperture provides access to said power source.

9. A rotatable toy comprising a rotatable body; an axis of rotation for said body; at least one light emitting diode in said body spaced radially from said axis of rotation such that when said body is rotated, said diode rotates about said axis of rotation; a solid state control circuit carried by said body and connected to said diode, said circuit including timing means to periodically supply power to said diode to cause said diode to flash so as to produce a stroboscopic effect; a power source carried by said body and connected to said control circuit to power said light emitting diode, and means for securing said power source in said body, said means including a cover member with at least one aperture for allowing access to said power source, said cover member further forms a portion of said body, and encloses a chamber in said body.

10. A rotatable toy as in claim 9 including a transistor switch connected to said control circuit to turn said light emitting diode on and off.

11. A rotatable toy as in claim 9 in which said body consists of spaced body halves having inner surfaces facing each other and outer surfaces facing away from each other, a rim surface disposed between and connecting said inner and outer surfaces and forming the periphery of each of said body halves, an axle disposed between and spacing apart said body halves, said axis of rotation being coincident with said axle, and at least one light emitting diode carried by at least one of said body halves.

12. A rotatable toy as in claim 11 including an LED disposed in each body half.

13. A rotatable toy as in claim 11 in which each body half is formed of translucent material so as to display light emitted from said light emitting diode.

14. A rotatable toy as in claim 11 including a rotatable disc positioned between said cover member and said chamber said disc defining an aperture such that alignment of said disc aperture and said cover member aperture provides access to said power source.

15. A rotatable toy as in claim 9 in which said control circuit is operative to activate said LED at a plurality of predetermined frequencies.

16. A rotatable toy as in claim 15 in which said control circuit includes timing means operative at said plurality of predetermined frequencies to periodically energize said LED to produce said stroboscopic effect.

17. A rotatable toy as in claim 16 including manually operated switch connected to said control circuit operative to determine the desired frequency of operation of said LED.

* * * * *